US009015893B2

(12) United States Patent
Vaynberg et al.

(10) Patent No.: US 9,015,893 B2
(45) Date of Patent: Apr. 28, 2015

(54) BRUSH WITH INTERNAL COMPARTMENT

(76) Inventors: Eugene Vaynberg, Philadelphia, PA (US); Victoria Vaynberg, New York, NY (US); Elkhan Guseynov, Englewood, NJ (US); Gary Berg, Newtown, PA (US)

( * ) Notice: Subject to any disclaimer, the term of this patent is extended or adjusted under 35 U.S.C. 154(b) by 535 days.

(21) Appl. No.: 12/734,460

(22) PCT Filed: Nov. 4, 2008

(86) PCT No.: PCT/US2008/012463

§ 371 (c)(1),
(2), (4) Date: Jul. 10, 2010

(87) PCT Pub. No.: WO2009/061398

PCT Pub. Date: May 14, 2009

(65) Prior Publication Data

US 2010/0284727 A1 Nov. 11, 2010

Related U.S. Application Data

(63) Continuation-in-part of application No. 11/936,679, filed on Nov. 7, 2007, now abandoned.

(51) Int. Cl.
*A46B 9/04* (2006.01)
*A46B 11/00* (2006.01)

(52) U.S. Cl.
CPC ..... *A46B 9/04* (2013.01); *A46B 11/0024* (2013.01); *A46B 2200/1066* (2013.01)

(58) Field of Classification Search
CPC ..... A46B 9/025; A46B 9/026; A46B 9/04
USPC ..... 15/167.1, 207.2; D4/104, 105
See application file for complete search history.

(56) References Cited

U.S. PATENT DOCUMENTS

| | | | | |
|---|---|---|---|---|
| 2,779,505 | A * | 1/1957 | Sipmann | 401/155 |
| 4,963,046 | A * | 10/1990 | Eguchi | 401/160 |
| 5,655,249 | A * | 8/1997 | Li | 15/167.1 |
| 5,735,011 | A * | 4/1998 | Asher | 15/167.1 |
| 6,016,587 | A * | 1/2000 | Savitt et al. | 15/205.2 |
| 6,070,286 | A * | 6/2000 | Cardarelli | 15/167.1 |
| 6,685,375 | B1 * | 2/2004 | Crocker | 401/176 |
| 6,993,804 | B1 * | 2/2006 | Braun et al. | 15/167.1 |
| 7,168,125 | B2 * | 1/2007 | Hohlbein | 15/167.1 |
| 7,356,866 | B2 * | 4/2008 | Chan | 15/22.1 |
| 7,722,278 | B2 * | 5/2010 | Black | 401/287 |
| 2004/0117934 | A1 * | 6/2004 | Pfenniger et al. | 15/167.1 |
| 2007/0041779 | A1 * | 2/2007 | Kuo | 401/188 R |
| 2009/0044356 | A1 * | 2/2009 | Noble et al. | 15/167.1 |
| 2011/0047734 | A1 * | 3/2011 | Jimenez et al. | 15/167.1 |
| 2011/0047736 | A1 * | 3/2011 | Jimenez et al. | 15/167.2 |
| 2011/0138560 | A1 * | 6/2011 | Vitt et al. | 15/167.1 |
| 2013/0255017 | A1 * | 10/2013 | Lee | 15/167.1 |

* cited by examiner

*Primary Examiner* — David Walczak
*Assistant Examiner* — Bradley Oliver
(74) *Attorney, Agent, or Firm* — Caesar, Rivise, Bernstein, Cohen & Pokotilow, Ltd.

(57) ABSTRACT

A brush including a handle and a head attached to the handle. The head has an upper surface and at least one protuberance positioned on the upper surface of the head. A plurality of bristle elements extend from the upper surface of the head and are positioned around the protuberance such that bristle elements positioned closest to the protuberance define a cup-shaped clearance space around the protuberance.

4 Claims, 5 Drawing Sheets

BRUSH WITH INTERNAL COMPARTMENT

FIELD OF INVENTION

The present invention is directed to a brush, either manual or powered, which used to hold and apply various substances, for example toothpaste.

BACKGROUND OF THE INVENTION

A head of a conventional brush or a toothbrush usually has a flat or slightly altered surface to which a plurality of stand up elements is attached. Usually the stand up elements are natural bristles or strands of plastic materials(s) formed into tufts bundles, or other groupings. The stand up elements are attached to the head either before or after forming the brush.

Various approaches have been advanced in the prior art for orienting the stand up elements on a brush.

U.S. Pat. No. 2,083,217 issued Jun. 8, 1937 to E. I. Brothers, et al. discloses two or three circular brush sections which are arranged within cups 5 and 5' that may be screwed into mating receptacles in the tooth brush handle so that they can be removed and replaced as needed (page 2, lines 52 70). Each brush section contains stiff cleaning elements and is spaced from the other along longitudinal axis of the handle at a distance less than the thickness of a tooth so that the brush operates on both the lingual (inside) and facial (outside) surfaces of the teeth (page 2, column 1, line 71 to column 2, line 9).

U.S. Pat. No. 5,604,951 describes a toothbrush with a head containing a flexible, rubber-like prophylaxis polishing cup or "prophy cup" similar to that used by dental personnel to professionally cline teeth. This prophy cup is loaded with toothpaste by the user and applied to the teeth. According to this patent, the "soft rubber-like prophy cup device follows the contours of teeth more effectively than bristles." This patent also discloses a ring of cleaning elements ("bristle tufts") placed about the periphery of the toothbrush head which co-act with the prophy cups to clean the user's teeth and gums.

SUMMARY

In one aspect, a brush is disclosed, the brush including a handle and a head attached to the handle. The head has an upper surface and at least one protuberance positioned to the upper surface of the head. A plurality of the bristle elements extend from the upper surface of the head and are positioned around the protuberance such that bristle elements positioned closest to the protuberance define a cup-shaped clearance space around the protuberance.

DETAILED DESCRIPTION

In accordance with the one preferred embodiment of the invention, a brush device 1 is provided with a head 2 and a handle 3. Although, this embodiment is illustrated using a toothbrush, it should be understood by a person skilled in the art that the invention, as claimed, may be applied to any type of brushed or similar devices having stand up bristle elements, for example, paint brushes, shaving brushes, etc.

Figure 2:
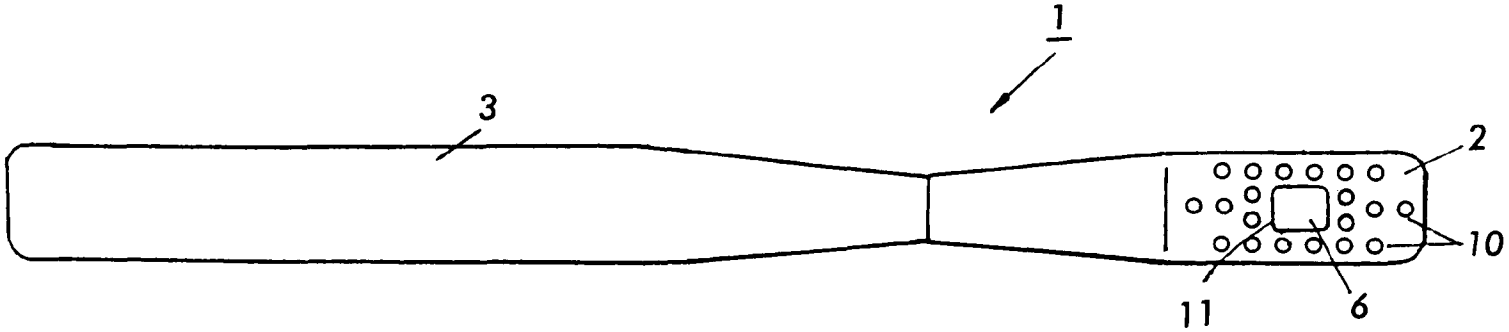
FIG. 2 is a top view of the embodiment of the brush device shown in FIG. 1.
Figure 1:
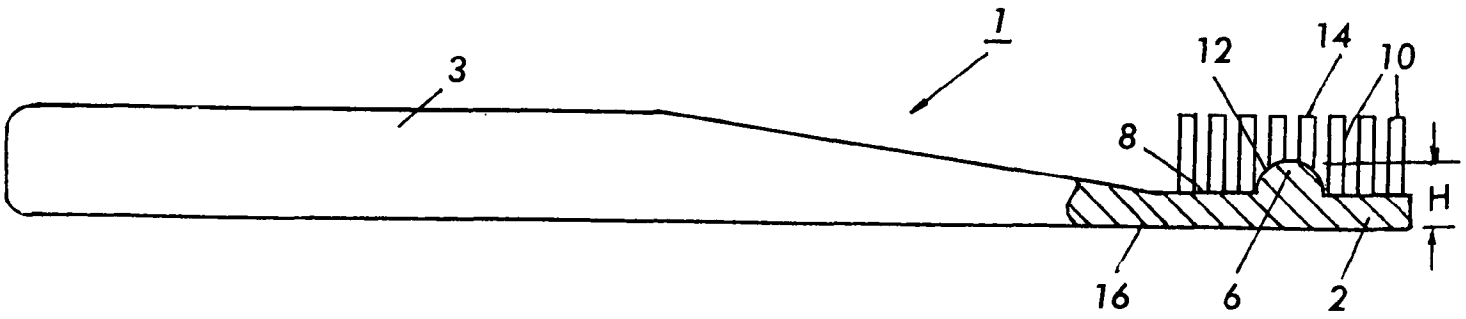
FIG. 1 is a side cross sectional view of the first embodiment of the brush device in accordance with the present invention.

As shown in FIGS. 1-2, head 2 includes at least one protuberance 6 formed on its upper surface 8. The remainder of the upper surface 8 is preferably flat. Although protuberance 6 is shown as having oval shape, any other shape, for example, circular, semi-circular, diamond, figure-eight, rectangular, triangular or any other, may be used. A plurality of stand up bristle elements 10 is attached to the upper surface 8 surrounding the protuberance 6 such that bristle elements 10 closest to the protuberance form a cup-shaped structure 11 around the protuberance. Further, bristle elements 10 closest to protuberance 6 are preferably more densely allocated on the upper surface 8 than the bristle elements positioned on the remainder of the upper surface.

The height H of the protuberance 6 is preferably selected such that the top surface 12 of the protuberance is raised above the surface 8 of the brush device but is positioned below an upper plane 14 of the cup-shaped structure 11 of the bristle elements closest to the protuberance. Top surface 12 preferably has a convex shape. However, the top surface may be formed flat. Although the first preferred embodiment is described as having only one protuberance 6 with a single cup-shaped structure 11 formed around the protuberance, multiple protuberances/cup-shaped structures may be formed on the upper surface 8 of the brush head.

Figure 6:
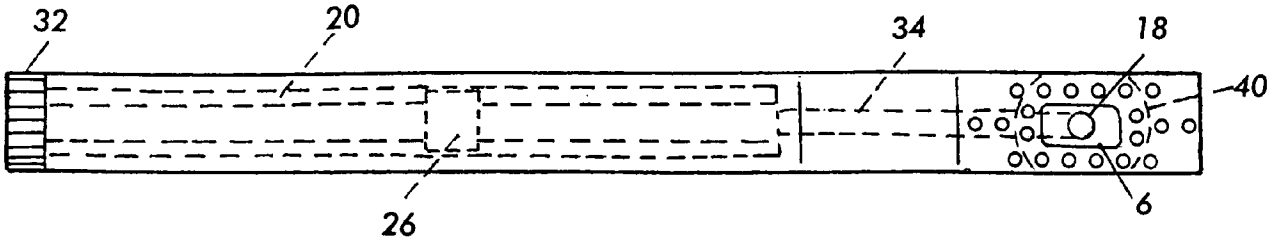
FIG. 6 is a top view of the embodiment of the brush device shown in FIG. 5.
Figure 8:
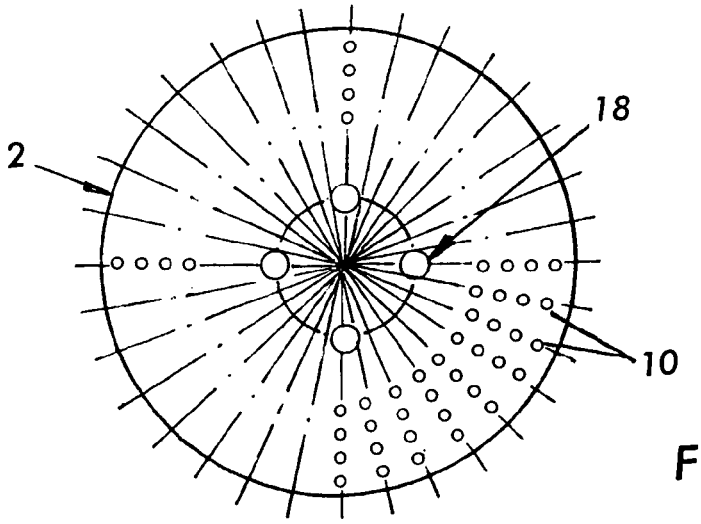
FIG. 8 is a top view of the embodiment of the brush device shown in FIG. 7.
Figure 7:
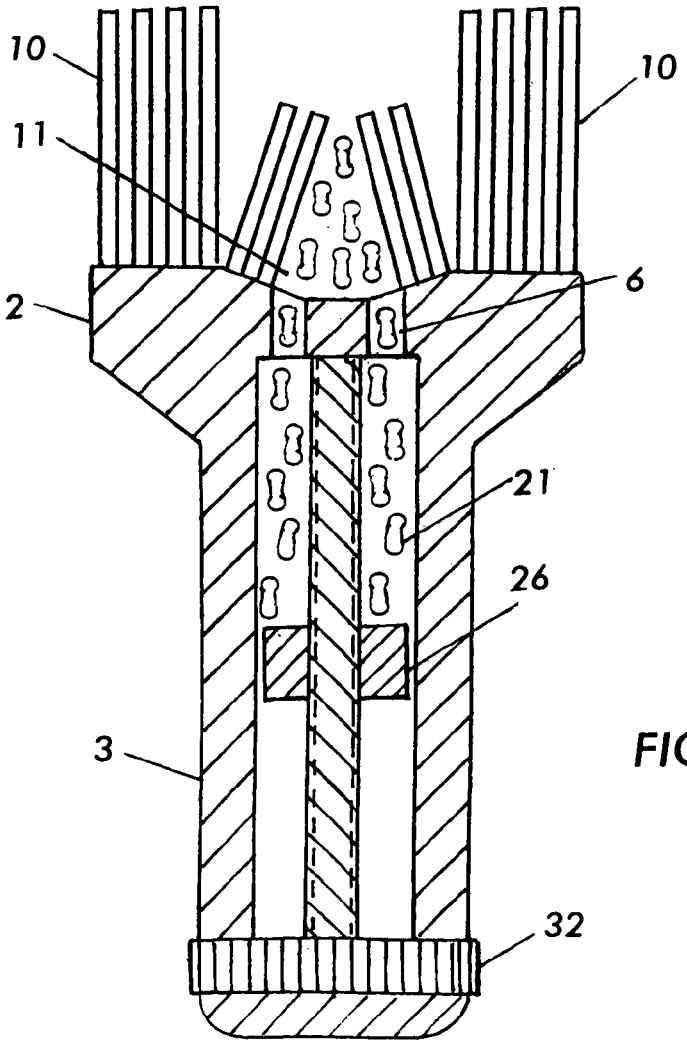
FIG. 7 is a side cross-sectional view of the alternative embodiment of the brush device in accordance with the present invention.

An alternative embodiment of the brush device is shown in FIGS. 7 and 8 showing a shaving cream brush, where like elements are designated with the same numerals as in FIGS. 1-6.

Bristle elements 10 may be positioned perpendicularly to the upper surface 8 of the brush or may be inclined at an angle with respect to this upper surface. A combination of both perpendicular and inclined bristle elements is also possible. Further, in the preferred embodiment shown in FIG. 1, all bristle elements 10 have the same height. However, the height of the bristle elements may be different. For example, in one preferred embodiment, the height of the bristle elements increases outwardly from the bristle elements forming the cup-shaped structure 11 toward outer bounds of the upper surface 8 of the head. Accordingly, top surfaces of the bristle elements 10, in this embodiment, form a concave surface. An embodiment where a portion of the bristle elements have a gradually increasing height and a portion has the same height is also possible.

Figure 4:
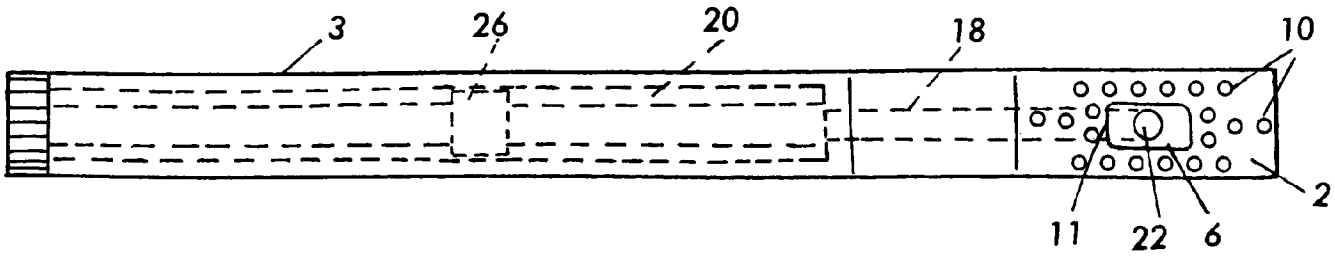
FIG. 4 is a top view of the embodiment of the brush device shown in FIG. 3.
Figure 3:
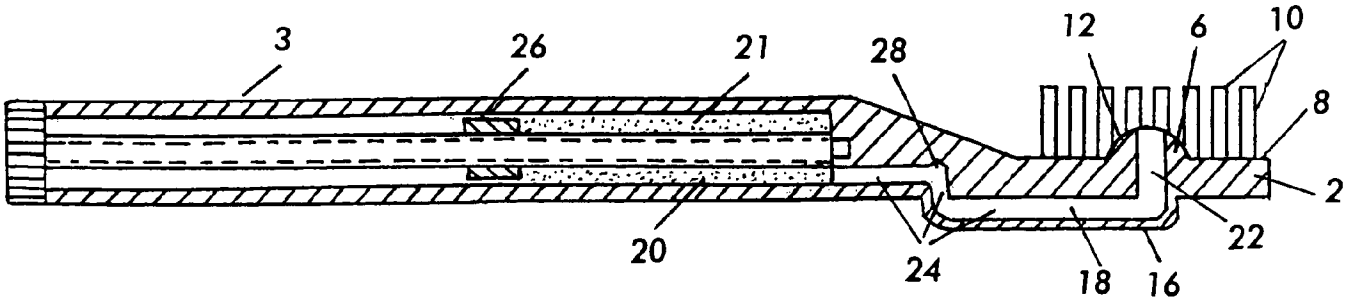
FIG. 3 is a side cross-sectional view of the second embodiment of the brush device in accordance with the present invention.
Figure 9:
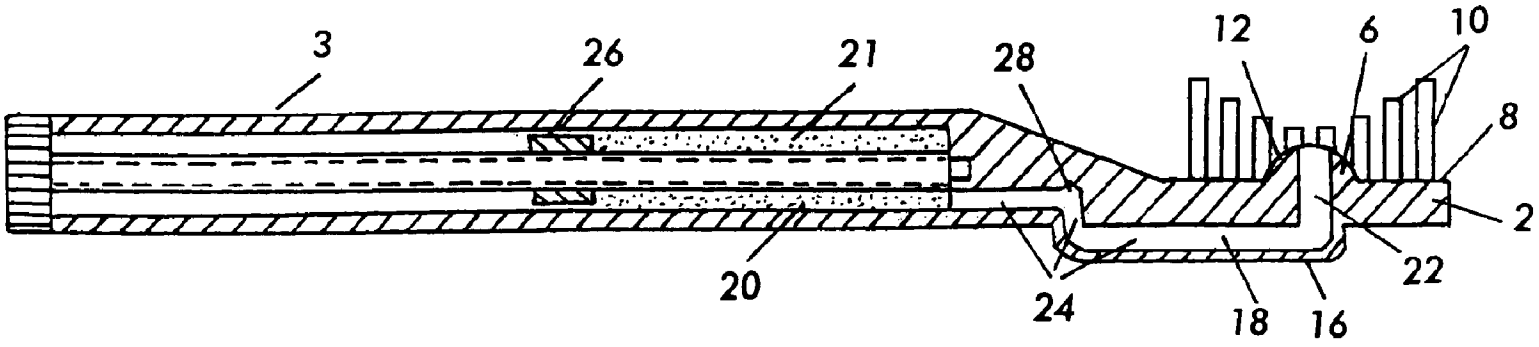
FIG. 9 is a side cross-sectional view of an embodiment of the invention wherein top portions of the bristle elements have a generally concave configuration.

As shown in FIGS. 3, 4 and 9, in other embodiments, handle 3 is formed with an interior hollow space 20 which is preferably filled up with the substance 21 to be applied by the brush. At least one vertical channel 22 is formed in the protuberance 6 opening at the top surface 12. Vertical channel 22 is preferably perpendicular to the upper surface 8. Hollow space 20 is connected to the vertical channel 22 via a plurality of connecting channels 24. Connecting channels 24 preferably include a horizontal channel 18, positioned in proximity to the bottom surface 16 of the head and formed in parallel to the upper surface 8, and an elbow-shaped channel 28. The elbow-shaped channel connects the hollow space 20 to the horizontal channel 18, which is in turn connected to the vertical channel 22. This multi-channel construction allows the substance 21 to flow smoothly from the hollow space 20 onto the top surface 12 of the protuberance 6 through the vertical channel 22.

A plunging mechanism 26 is provided within the hollow space 20 to push the substance 21 from the hollow space 20 into the connecting channels 24, then into the vertical channel 22 and then onto the top surface 12 of the protrusion 6. Plunging mechanism 26 may be realized as any known plunging structure. For example, a conventionally known bolt or pump mechanism may be utilized. Further, plunging mechanism may be actuated mechanically, for example using a turning wheel 32 located at the distal end of the handle, or electrically, as conventionally known.

Figure 5:
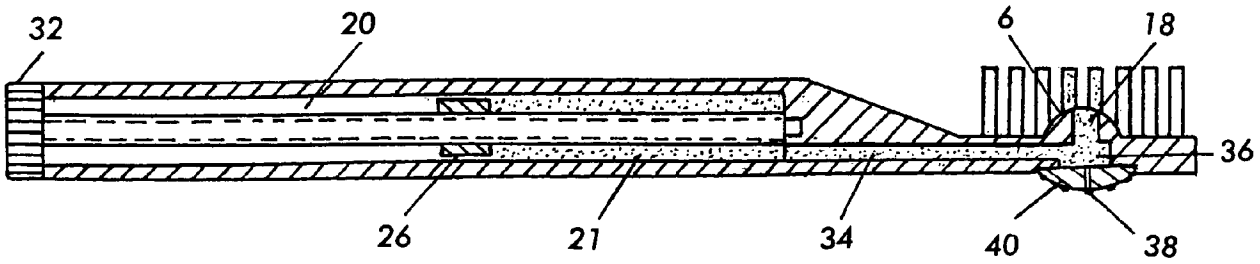
FIG. 5 is a side cross-sectional view of the third embodiment of the brush device in accordance with the present invention.

An alternative embodiment of the connection between the hollow space 20 and the vertical space 18 is shown in FIGS. 5 and 6. In this embodiment, a straight horizontal channel 34 connects the hollow space 20 directly to the vertical channel 18. An accumulation space 36 is provided below the intersection of the straight horizontal channel 34 with the vertical channel 18. Accumulation space 36 has an outside opening 38 covered entirely with a deformable push button 40. As plunging mechanism 26 pushes substance 21 from the hollow space 20 into the straight horizontal channel 34 and into the vertical channel 18, the accumulation space 36 fills up with the substance 21, creating a substance reserve. If necessary, this reserve may be utilized by depressing the push button such that the push button deforms inside the accumulation space 36 forcing the substance 21 from the accumulation space into the vertical channel 18.

In use, when substance 21 is accommodated within the cup-shaped structure 11, and the user begins the application process, the cup-shaped structure prevents the substance 21 from excessively spilling over the top of the bristle elements (this wasting the applied substance), and the convex shape of the protrusion 6 enables an even distribution of the substance to all bristle elements.

While there have been shown and described and pointed out fundamental novel features of the invention as applied to the preferred embodiments thereof, it will be understood that various omissions and substitutions and changed in the form and details of the devices and methods illustrated, and in their operation, may be made by those skilled in the art without departing from the spirit of the invention. For example, it is expressly intended that al combinations of those elements, which perform substantially the same function in substantially the same way to achieve the same results are within the scope of the invention. It is the intention, therefore, to be limited only as indicated by the scope of the claims appended hereto.

We claim as follows:

1. A brush device consisting essentially of:

a handle;

a head attached to the handle, the head including an upper surface and at least one protuberance positioned on the upper surface of the head; and a plurality of bristle elements extending from the upper surface of the head and being positioned around the protuberance wherein the bristle elements located closest to the protuberance and surrounding the protuberance are more densely allocated on the upper surface of the head than other bristle elements positioned on the remainder of the upper surface of the head, and define a cup-shaped clearance above the protuberance so that a substance is applied from above into it; and a top surface of the protuberance is raised above the upper surface of the head but is positioned below an upper plane defined by ends of the more densely allocated bristle elements surrounding the cup-shaped clearance space so as to prevent a substance applied into the cup-shaped clearance space from excessively spilling over the upper plane of the bristle elements and to enable an even distribution of the substance to all bristle elements.

2. The brush device of claim 1, which consists of the handle, the head, the at least one protuberance and the plurality of bristles.

3. A brush device consisting essentially of:

a handle;

a head attached to the handle, the head including an upper surface and at least one protuberance positioned on the upper surface of the head; and a plurality of bristle elements, wherein: (a) the bristle elements extend from the upper surface of the head; (b) the bristle elements are positioned around the at least one protuberance such that bristle elements positioned closest to the at least one protuberance define a cup-shaped clearance space above the at least one protuberance; (c) the bristle elements located closest to the at least one protuberance and surrounding the at least one protuberance are more densely allocated on the upper surface of the head than other bristle elements positioned on a remainder of the upper surface of the head; (d) the bristle elements have varying heights; (e) a surface formed by top portions of the bristle elements has a generally concave configuration; and (f) a top surface of the at least one protuberance is raised above the upper surface of the head but is positioned below the surface formed by the top portions of the bristle elements.

4. The brush device of claim 3, which consists of the handle, the head, the at least one protuberance and the plurality of bristles.

* * * * *